US009675127B2

(12) United States Patent
Guadagnin et al.

(10) Patent No.: US 9,675,127 B2
(45) Date of Patent: Jun. 13, 2017

(54) PROTECTIVE HELMET OF REDUCIBLE DIMENSIONS FOR SPORTS USE, IN PARTICULAR FOR USE BY CYCLISTS

(75) Inventors: Paolo Guadagnin, Pederobba (IT); Ivo Benvegnu', Padova (IT)

(73) Assignee: SAFILO SOCIETA AZIONARIA FABRICA ITALIANA LAVORAZONE OCCHIALI S.P.A., Pieve de Cadore (BL) (IT)

( * ) Notice: Subject to any disclaimer, the term of this patent is extended or adjusted under 35 U.S.C. 154(b) by 422 days.

(21) Appl. No.: 14/360,069

(22) PCT Filed: Nov. 28, 2011

(86) PCT No.: PCT/IB2011/055338
§ 371 (c)(1),
(2), (4) Date: May 22, 2014

(87) PCT Pub. No.: WO2013/079989
PCT Pub. Date: Jun. 6, 2013

(65) Prior Publication Data
US 2014/0310856 A1 Oct. 23, 2014

(51) Int. Cl.
*A42B 3/04* (2006.01)
*A42B 3/32* (2006.01)

(52) U.S. Cl.
CPC ..... *A42B 3/04* (2013.01); *A42B 3/322* (2013.01)

(58) Field of Classification Search
CPC .. A42B 3/32; A42B 3/322; A42B 3/04; A42B 3/066
See application file for complete search history.

(56) References Cited

U.S. PATENT DOCUMENTS 5,012,533 A 5/1991 Raffler
5,515,546 A 5/1996 Shifrin
(Continued)

FOREIGN PATENT DOCUMENTS

DE 1053195 B * 3/1959 ..... A42B 3/322
DE 19932030 A1 * 2/2000 ..... A42B 3/281
(Continued)

*Primary Examiner* — Shaun R Hurley
*Assistant Examiner* — Andrew W Sutton
(74) *Attorney, Agent, or Firm* — Volpe and Koenig, P.C.

(57) ABSTRACT

A protective sports helmet includes a cap structure having a plurality of structurally independent cap portions and mutually connected to flexible interconnecting members such that the helmet has at least one overall configuration of minimum dimensions when not worn, with the parts of the cap mutually adjacent to each other, separate from an operating condition having maximum dimensions when worn. The parts of the cap are held together by interconnecting members in positions at a suitable distance from each other configured to enclose a user's head. The portions include corresponding sections each extending continuously between the frontal and occipital extremities, of longitudinal extent between those extremities which predominates in comparison with their transverse extent, the sections extending substantially parallel and at a distance from each other so that in the configuration having the minimum dimensions adjacent sections abut each other along lateral sides which transversely bound each section.

8 Claims, 2 Drawing Sheets

(56) References Cited

U.S. PATENT DOCUMENTS

| | | | | |
|---|---|---|---|---|
| 5,604,935 | A * | 2/1997 | Nezer | A42B 3/322 2/410 |
| 6,209,139 | B1 * | 4/2001 | Schmidt | A42B 1/206 2/171.1 |
| 6,442,765 | B1 | 9/2002 | Fallon et al. | |

FOREIGN PATENT DOCUMENTS

| | | | | | |
|---|---|---|---|---|---|
| EP | 0280042 | A1 | 8/1988 | | |
| EP | 1435804 | A2 | 7/2004 | | |
| FR | WO 2007068846 | A1 * | 6/2007 | ..... | A42B 3/322 |
| GB | 2527173 | A * | 8/2016 | ..... | A42B 3/066 |
| IT | WO 2013079989 | A1 * | 6/2013 | ..... | A42B 3/322 |

* cited by examiner

PROTECTIVE HELMET OF REDUCIBLE DIMENSIONS FOR SPORTS USE, IN PARTICULAR FOR USE BY CYCLISTS

TECHNICAL SCOPE

This invention relates to a protective helmet of reducible dimensions for sports use, in particular for use by cyclists, having the characteristics indicated in the precharacterising clause of principal claim no. 1.

STATE OF THE ART

In the specific technical field of protective helmets for sports use, in particular for use by cyclists, and therefore specifically designed to provide protection against falls or impacts, helmets on which the structure of the protective cap is designed as a single piece whose shape is intended to fit the shape of the head as well as possible without constrictions and without leaving any slack in covering the same are predominantly produced. Further support devices with mechanisms for adjusting the fit may supplement this structure of the conventional protective cap type.

Within the more restricted scope of use of protective helmets, in particular by cyclists, for example those particularly intended for urban use where mobility is associated with working requirements, as well as for the actual practice of sports per se, helmets of conventional structure as described above are not particularly easy to handle and transport when removed the head, particularly because of their size.

In order to overcome the aforesaid limits the known art has proposed helmet structures which can be reduced in size when not worn, in which the protective cap comprises a plurality of parts of suitable rigidity and in any event designed for the protective function against impacts and falls, connected together by means of flexible interconnecting members. These interconnecting members typically comprise flexible straps connecting separate parts of the cap, which on the one hand allow the parts of the cap to adopt a maximum size configuration when a helmet is worn on the head, adapting to the shape of the same, while on the other hand allowing the helmet to adopt a configuration of small size when removed from the head, as a result of the parts of the helmet moving closer to each other. One example of such a protective helmet structure is known from EP 1435804.

In helmets of this type the requirement to achieve the maximum possible reduction in size, to allow them to be transported more practically and conveniently when not worn, is obviously inconsistent with the requirement to provide a cap structure which ensures suitable protection for the head similar to that offered by conventional monolithic helmet structures, and in any event such as to satisfy the safety requirements specified by current regulations.

DESCRIPTION OF THE INVENTION

The main object of the invention is that of providing a protective helmet structure of the aforesaid type which is capable of achieving an improved compromise between the abovementioned opposing requirements in comparison with known solutions, to improve practicality and convenience of transport when not worn, achieving a marked reduction in dimensions but at the same time ensuring the safety standards specified for the protective function when worn by the user, and also achieving a pleasing aesthetic effect in addition to the abovementioned functional aspects.

This and other objects are accomplished by the invention through a protective helmet of reducible dimensions for sports use, in particular for use by cyclists, constructed according to the appended claims.

BRIEF DESCRIPTION OF THE DRAWINGS

Further characteristics and advantages of the invention will be more apparent from the following detailed description of a preferred embodiment illustrated indicatively and without restriction with reference to the appended drawings in which.

PREFERRED EMBODIMENT OF THE INVENTION

With reference to the figures mentioned, 1 indicates as a whole a protective helmet for sports use, in particular for use by cyclists, constructed according to this invention. As will be clearly apparent below, the helmet is of the type having reducible dimensions, that is to say it is designed to adopt a configuration having reduced dimensions which is different from the operating configuration in which it performs the protective function when worn on the user's head, in order to render movement and transport of the same when it is not worn more convenient and practical.

The helmet comprises a protective cap structure 2 having a plurality of cap portions which are structurally independent of each other and attached to each other through an interconnecting framework of flexible members, indicated as a whole by 4.

Figure 3:
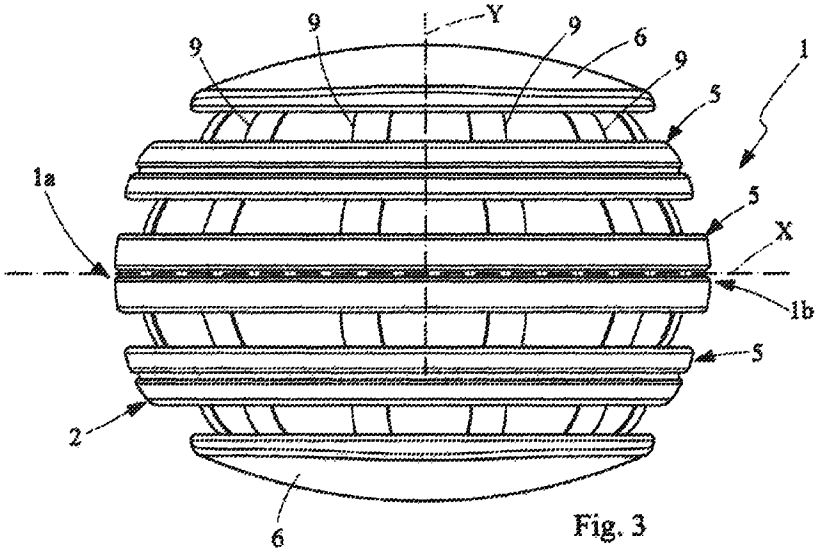
FIG. 3 is a plan view from above of the helmet in the preceding figures.
Figure 2:
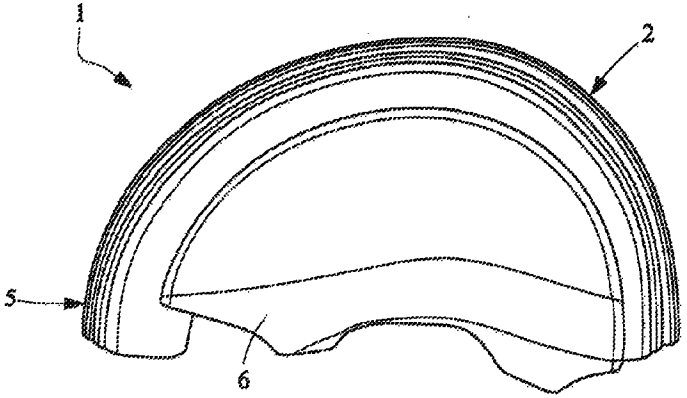
FIG. 2 is a view in lateral elevation of the helmet in FIG. 1.
Figure 5:
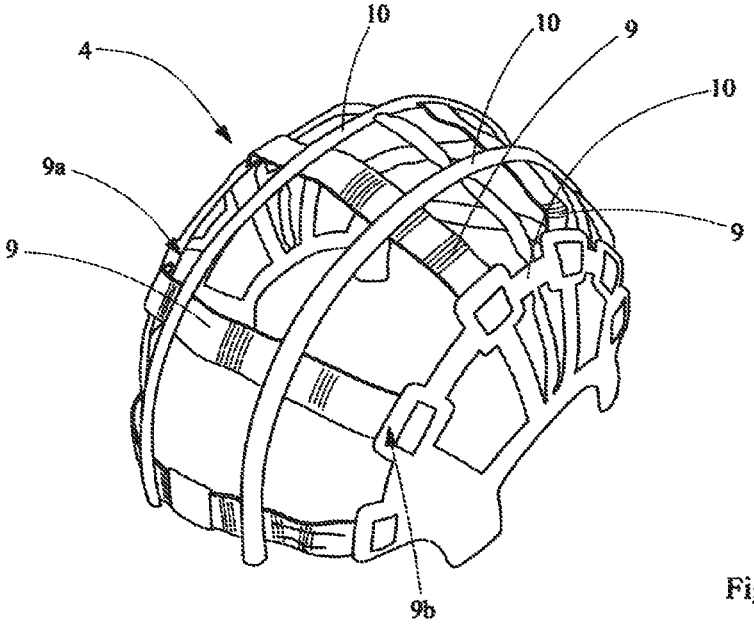
FIG. 5 is a perspective view of a detail of the helmet in the preceding figures during a stage of construction of the same.

With reference to FIG. 3, which shows a plan view of helmet 1 from above, X indicates projection in a longitudinal direction of the helmet between an anterior frontal extremity 1*a* and a longitudinally opposite posterior occipital extremity 1*b*. In that figure the transverse direction of the helmet perpendicular to the X axis is indicated by Y.

According to a principal characteristic of the invention, over the majority of the structure of cap 2 the cap portions comprise sections of cap, all indicated by 5, all of which extend continuously between extremities 1*a*, 1*b*, of longitudinal extent (measured in the direction of the X axis) between the said frontal extremity 1*a* and occipital extremity 1*b* which predominates in comparison with their transverse extent (along the Y axis), sections 5 extending along the longitudinal direction parallel to and at a distance from each other.

In the longitudinal direction, each section 5 has a curved profile of predetermined curvature corresponding to the curvature required in the cap structure to appropriately match the shape of the user's head.

In such a conformation the cap may adopt the configuration having minimum transverse dimensions, in which cap sections 5 butt against each other at the lateral sides 5*a* of the sections transversely delimiting each respective section.

Figure 1:
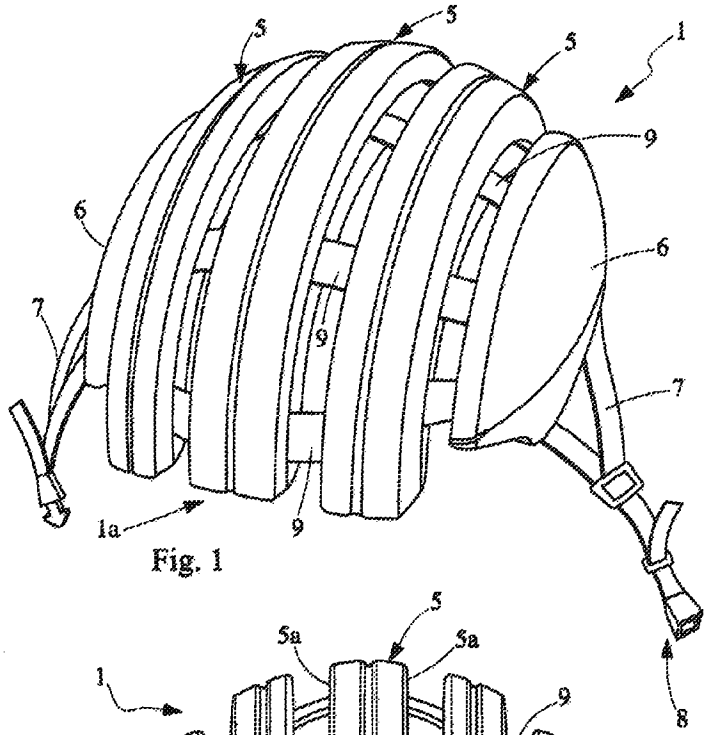
FIG. 1 is a perspective view of a helmet constructed according to the invention.
Figure 4:
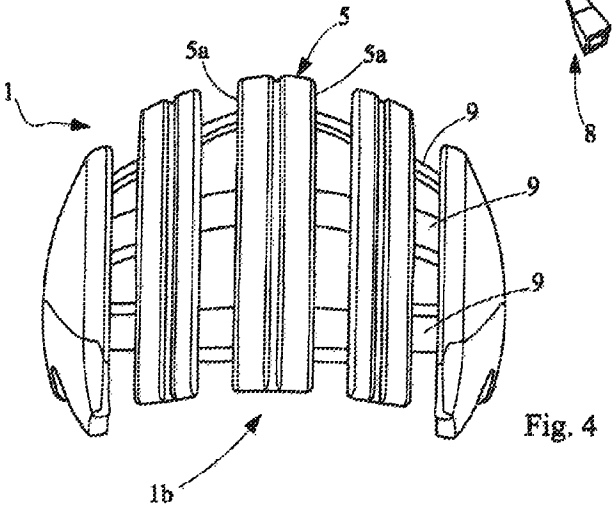
FIG. 4 is a view in lateral elevation of the back of the helmet in the preceding figures.

The helmet is also provided with a pair of opposing lateral portions 6, designed to protect corresponding lateral regions of the head, extending close to the ear regions of the head, which are connected to corresponding cap sections 5, as clearly shown in the figures. From portions 6 there extend downwards corresponding straps 7 of a securing strap device 8 which is tightened in the area beneath the chin, of substantially conventional type, and only diagrammatically shown in FIG. 1.

Framework 4 interconnecting cap sections 5 comprises a plurality of flexible straps 9 extending transversely to the longitudinal direction and intended to be interconnected at each of sections 5 crossed, between adjacent cap sections 5, leaving separate a portion of corresponding strap 9 which has a degree of flexibility such as to allow the adjacent sections to move towards each other or away from each other in a transverse direction, but with limited capacity for relative movement in the longitudinal direction. Straps 9 are conveniently manufactured from nylon fabric, for example of the type specified for manufacturing the securing straps for the helmet.

In addition to nylon, the flexible straps may comprise knitted or woven yarns or metal cable, or fabric of yarn obtained from other materials of natural or synthetic origin which are alternatives to nylon, for example an aramid fibre (Kevlar).

In further variant embodiments the flexible elements may comprise straps or plates of nylon or other materials of synthetic or natural origin, provided that the requirement that these members should have adequate resilient deformability is fulfilled.

A preferred embodiment provides for a plurality of straps 9 lying side by side in the longitudinal direction, in which each strap 9 extends transversely to the said longitudinal direction and is secured at its opposing ends 9*a*, 9*b* to the corresponding opposite lateral portions 6 of the cap, each strap also crossing the plurality of cap sections 5 with which it is stably interconnected. In this respect it is provided that each cap section 5, like lateral portions 6, comprises an internal core 10 extending longitudinally in the corresponding section and intended to be embedded in the expanded material forming the section, a corresponding connection being provided between core 10 and corresponding strap 9 intersecting it, transversely crossing corresponding section 5. Internal core 10 is preferably made of a plastics material and is obtained by injection moulding of that material in an appropriate mould.

Figure 6:
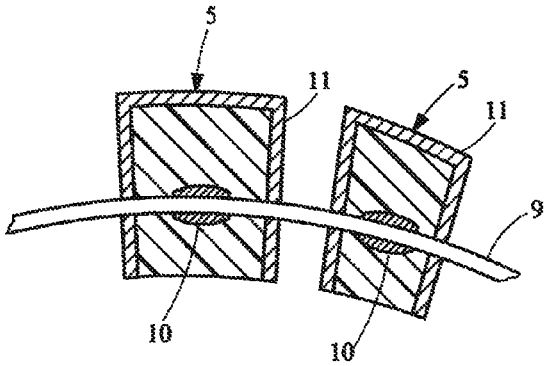
FIG. 6 is a diagrammatical view in partial cross-section and on a magnified scale of a detail of the structure of the helmet according to the invention.

FIG. 6 shows the area of interconnection between the strap and core of a cap section. This interconnection may be made using the process for injection moulding of the core, if the flexible framework system of straps 9 is first positioned in a mould for simultaneous injection of all the cores provided for a single helmet. In this way, as the molten plastics material for the core is injected it incorporates the strap in the interconnection zone, becoming attached to the strap after the plastic has cooled and solidified.

As an alternative, attachment between the strap and core in the interconnection zone may be achieved using rivets. In this case it is provided that each strap and each core should have a through hole corresponding to each of the interconnections provided in all of flexible framework 4. The rivets which are to be subsequently riveted with consequent attachment between the strap and the core are inserted into each of the holes.

Other means which may be used for making interconnections between the strap and core comprise for example screw, heat-welded or adhesive bonded attachments.

It is also provided that cap sections 5 are made of expanded polystyrene, which is at least partly covered by corresponding shells 11 of thin plastics material. Shells 11, which provide an external protective coating for each cap section 5 to increase resistance to impacts, cuts and scratches, are conveniently made by the thermo-forming of semi-finished products of plastics material.

A preferred method of manufacture provides for a suitable mould for injection into which thin plastics shells 11 of arched shape are inserted, each having a conformation corresponding to a corresponding cap section 5 which has to be manufactured. Each shell 11 has a curvature corresponding to the curvature of the top surface of cap section 5 with which it is associated. Flexible framework 4, comprising straps 9 interconnected to system of cores 10, is also positioned in the same mould. The attachment means specified, such as the straps of the securing system beneath the chin and any supports/adjusters for the occipital region can also be attached to the framework, which provides a sort of internal reinforcement for the cap. Once the mould has been closed, expanded polystyrene is injected into the mould; during injection the materials forms cap sections 5 and lateral portions 6, adhering to corresponding plastics shells 11 and bonding to them. At the same time, the expanded material partly incorporates the flexible framework reinforcement, in such a way that straps 9 are embedded in the expanded material along their length which cross corresponding cap sections 5, longitudinal cores 10 in turn being embedded in corresponding sections 5 over their entire length, and not therefore being visible. The procedure described advantageously makes it possible to obtain the entire helmet structure in a single operation of injecting/expanding the material.

In a variant of the procedure described above, plastics shells 11 are not inserted into the mould before injection of the expanded polystyrene, but are inserted into the same mould after injection/expansion of the polystyrene and opening of the mould, in such a way that each shell 11 lies on its corresponding section 5; the mould is then closed again, and the mould is heated so that the materials of sections 5 and shells 11 in contact with each other become welded together through a kind of thermal welding.

The flexibility of the reinforcement comprising strap system 9 incorporated in cap structure 2 advantageously provides the helmet with deformability almost exclusively in the transverse direction; cap sections 5 can therefore move towards each other laterally (or vice versa move away from each other), without any other degrees of freedom in relative movement being substantially permitted. More specifically, a limited capacity for relative movement between adjacent sections 5 in the longitudinal direction is possible and is associated with the nevertheless reduced flexibility of straps 9, mainly because the yielding nature of the fabric of which they are made, this characteristic allowing the cap structure to be adjusted to the shape of the head while in any event preserving the overall stability of the cap when worn.

Figure 7:
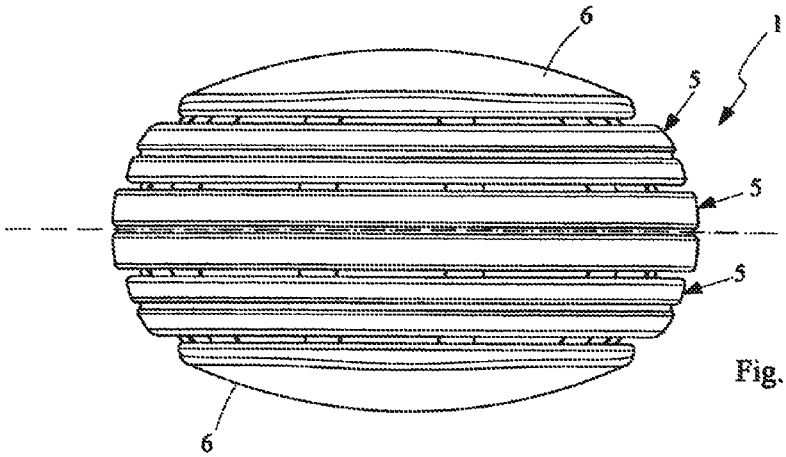
FIG. 7 is a view corresponding to that in FIG. 3, of the helmet configuration having minimum dimensions.

The configuration having minimum dimensions illustrated in FIG. 7 instead makes it possible for it to be transported more conveniently and more practically when not worn by the user, for example by placing it in a suitably shaped bag which will keep it compressed in its "reduced dimensions" configuration. When it has to be worn, the configuration having maximum dimensions is easily obtainable, that is the one corresponding to that having the maximum distances between the adjacent sections, distances determined by the extension of the interconnected straps between cap sections 5.

On the other hand, the provision of sections 5 extending within the cap without any break in continuity and having a monolithic structure along the longitudinal direction between the anterior frontal area and the posterior occipital area advantageously makes it possible to achieve a high degree of protection for the user's head against impacts or falls, in particular frontal and posterior impacts. It will be noted that in the stage in which sections 5 of the cap move together, the lengths of strap 9 of "flexible" material which remain visible in positions between adjacent cap sections are subjected to temporary deformation (reversible deformation). Straps 9 are in fact conveniently manufactured from soft material characterised by poor elastic properties, such as for example a "synthetic fabric" material. However, with regard to known conventional uses the abovementioned lengths of flexible strap (those which are effectively "free", that is not embedded within the sections of the cap) have an appreciably small ratio between length and thickness. In this way the lengths of strap in fact acquire greater resilience. The consequence of this is that when sections 5 are brought close together the lengths of strap are subjected to deformation substantially of the elastic type, that is they resist their deformation, a resistance which takes the form of an ability to return resiliently to their initial shape (simultaneously in all the lengths) as soon as the constricting conditions which kept sections 5 adjacent to each other no longer apply. The helmet therefore has a kind of resilient memory which makes it capable of independently returning from the shape having minimum dimensions to that having the maximum dimensions for use.

The invention thus accomplishes the proposed objects, providing the advantages mentioned in comparison with known solutions.

The invention claimed is:

1. A protective helmet, for sports use, comprising a cap structure (2) having a plurality of cap portions which are structurally independent of each other and mutually connected to flexible interconnecting members in such a way that the cap has at least one configuration of overall minimum dimensions when not worn, with the portions of the cap mutually adjacent to each other, differing from an operating configuration of maximum dimensions when the helmet is worn in which the portions of the cap are held by the said interconnecting members in positions mutually at a distance from each other configured to surround a user's head, wherein over a predominant part of the cap (2) extending between an anterior frontal extremity (1*a*) and an opposing posterior occipital extremity (1*b*) of the cap (2), the portions comprise corresponding cap sections (5) each of which extends continuously between the frontal and occipital extremities of longitudinal extent (X) lying between these extremities which predominates in comparison with their transverse extent, these sections (5) extending along the X direction substantially parallel and at a distance from each other so that in the configuration having minimum dimensions adjacent cap sections (5) butt against each other along their lateral sides (5*a*) which transversely delimit each section.

2. A helmet according to claim 1, wherein the interconnecting members comprise flexible straps (9) extending transversely to the longitudinal direction (X) and configured to be interconnected at each of the sections (5), the parts of each strap (9) remaining between adjacent sections of the cap having a degree of flexibility such as to permit the adjacent sections (5) to move towards each other or away from each other in a transverse direction (Y), but with a limited capacity for relative movement in the longitudinal direction (X).

3. A helmet according to claim 2, wherein each of the said sections (5) comprises an internal core (10) which is configured to be embedded in an expanded material of which the cap section (5) is formed, the internal core being interconnected with the corresponding strap which transversely crosses the corresponding section.

4. A helmet according to claim 3, wherein the expanded material of each cap section is at least partly covered by a thin shell (11).

5. A helmet according to claim 2, further comprising a plurality of straps (9) lying alongside each other in a longitudinal direction (X) and extending transversely to that direction and interconnected to the corresponding cap sections (5), each strap extending between opposite extremity sections (9*a*, 9*b*) located at the opposing lateral sides of the helmet.

6. A helmet according to claim 3 wherein the internal core (10) of each cap section (5) is a plastic material upon which there is injected an expanded polystyrene material of the cap section, and wherein the expanded material is covered with a thin shell (11) of plastic material.

7. A helmet according to claim 5, wherein the straps (9) connecting the cap sections (5) together are made of nylon fabric.

8. A helmet according to claim 1, wherein the helmet is a cyclist helmet.

* * * * *